US007177576B2

(12) United States Patent
Kamijo et al.

(10) Patent No.: US 7,177,576 B2
(45) Date of Patent: Feb. 13, 2007

(54) APPARATUS FOR FORMING IMAGE USING LIQUID DEVELOPMENT

(75) Inventors: Koichi Kamijo, Nagano-ken (JP); Hidehiro Takano, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/196,775

(22) Filed: Aug. 3, 2005

(65) Prior Publication Data

US 2006/0034639 A1 Feb. 16, 2006

(30) Foreign Application Priority Data

Aug. 16, 2004 (JP) ..... 2004-236498

(51) Int. Cl.
*G03G 15/10* (2006.01)

(52) U.S. Cl. ..... 399/237; 399/248

(58) Field of Classification Search ..... 399/237
See application file for complete search history.

(56) References Cited

U.S. PATENT DOCUMENTS

| | | | | |
|---|---|---|---|---|
| 5,555,079 | A | 9/1996 | Adachi et al. | |
| 5,604,061 | A * | 2/1997 | Sekido et al. | 430/60 |
| 5,937,247 | A * | 8/1999 | Takeuchi et al. | 399/237 |
| 6,640,073 | B2 * | 10/2003 | Kurotori et al. | 399/237 |
| 6,640,080 | B2 * | 10/2003 | Endo et al. | 399/349 |
| 2004/0005407 | A1 * | 1/2004 | Takeuchi et al. | 427/240 |
| 2006/0062594 | A1 * | 3/2006 | Kawasumi et al. | 399/159 |

FOREIGN PATENT DOCUMENTS

| | | |
|---|---|---|
| JP | 07-146601 | 6/1995 |
| JP | 07-325527 | 12/1995 |
| JP | 2000-235306 | 8/2000 |
| JP | 2002-287513 | 10/2002 |

* cited by examiner

*Primary Examiner*—David M. Gray
*Assistant Examiner*—Bryan Ready
(74) *Attorney, Agent, or Firm*—Hogan & Hartson LLP

(57) ABSTRACT

Widths of a coating area, a developing agent carrier, a maximum image area and a first cleaning member taken along a second direction are respectively W1, W2, W3 and W4, the following conditions are satisfied:

a first condition that W1>W2 is met and in the second direction, the both edges of the developing agent carrier are located on the inner side to the both edges of the coating area, a second condition that W2>W3 is met and in the second direction, the both edges of the image area are located on the inner side to the both edges of the developing agent carrier, and a third condition that W4>W2 is met and in the second direction, the both edges of the developing agent carrier are located on the inner side to the both edges of the first cleaning member.

3 Claims, 7 Drawing Sheets

APPARATUS FOR FORMING IMAGE USING LIQUID DEVELOPMENT

CROSS REFERENCE TO RELATED APPLICATION

The disclosure of Japanese Patent Application No. 2004-236498 filed Aug. 16, 2004 including specification, drawings and claims is incorporated herein by reference in its entirety.

BACKGROUND OF THE INVENTION

1. Field of the Invention

The present invention relates to an image forming technique of the electrophotographic type for a printer, a copier machine, a facsimile machine and the like, and more particularly, to an image forming technique which uses liquid development as a development method.

2. Description of the Related Art

Such an image forming apparatus of the electrophotographic type has been commercialized in which an exposure unit exposes a photosensitive member (latent image carrier) which has been charged up, thereby forming an electrostatic latent image on the photosensitive member, a developing unit makes toner adhere to the photosensitive member, thereby visualizing the electrostatic latent image and forming a toner image, and this toner image is transferred to a transfer paper, thereby obtaining a predetermined image. Known as the development method for the developing unit is a liquid development method using a liquid developing agent (liquid developing agent) in which toner is dispersed in a carrier liquid. Known as an image forming apparatus using such a liquid development method is a structure which comprises: a developer housing portion holding a liquid developing agent; a coating roller which is immersed in the liquid developing agent, and accordingly carriers on its surface the liquid developing agent and scoops up the liquid developing agent; a developer roller (developing agent carrier) which abuts on the coating roller and gets coated on its surface with the liquid developing agent; and a photosensitive member which abuts on the developer roller so that the liquid developing agent develops an electrostatic latent image carried on the photosensitive member. In the image forming apparatus having this structure, as the developer roller is coated with the liquid developing agent which has been carried once on the surface of the coating roller, the surface of the developer roller is uniformly coated with the liquid developing agent. The electrostatic latent image carried on the surface of the latent image carrier is developed with the liquid developing agent thus uniformly applied to the developer roller, an image without a varying density is obtained.

However, in the image forming apparatus having this structure, the liquid developing agent, which has built up at the edge surfaces of the coating roller immersed in the liquid developing agent, may be blown up to the developer roller and the photosensitive member as the coating roller rotates. When the liquid developing agent gets blown up to the developer roller and the photosensitive member from the edge surfaces of the coating roller, the amount of the liquid developing agent existing in a nip portion between the developer roller and the photosensitive member becomes uneven all over the nip area. As a result, an image which is formed has an uneven density, which deteriorates the accuracy of development.

As a solution to this problem, the following techniques have been proposed. In the apparatus described in Japanese Unexamined Patent Publication No. 2000-235306, since a developer roller is longer along the width direction than a coating area of a coating roller but shorter than the length of the coating roller including a non-coating area, it is possible to prevent blowing up of a liquid developing agent which has built up at the edge surfaces of the coating roller. In short, as the overall length of the coating roller is longer than the length of the developer roller, the both edges of the coating roller will not abut on the developer roller, thus preventing the liquid developing agent which has built up at the both edge surfaces of the coating roller from getting blown up to the developer roller. Further, since the overall length of the developer roller is longer than a coating area length of the coating roller, the both edges of the developer roller will not abut on the coating area of the coating roller, thus preventing stay of the liquid developing agent at the both edge surfaces of the developer roller. In this manner, it is possible to prevent deterioration of an image quality such as an uneven density of an image attributable to blowing up of an unwanted liquid developing agent from a coating roller to a developer roller.

SUMMARY OF THE INVENTION

By the way, there is a coating area approximately at the center of a developing agent carrier (developer roller), in accordance with a surface region of a latent image carrier where an image is to be formed. With a developer carried on a coating area of the developing agent carrier, development is performed. However, in an apparatus having this structure, the following problem could sometimes occur. That is, within an abutting portion where the developing agent carrier and a latent image carrier abut on each other, a friction factor against the latent image carrier is different between a central section (coating area) of the developing agent carrier coated with a liquid developing agent and the both edges of the developing agent carrier not coated with the liquid developing agent, and this serves as an obstacle against smooth rotations of the developing agent carrier and the latent image carrier which abut on each other. This could scratch the surface of the developing agent carrier or the latent image carrier within abutting portions where the latent image carrier abuts on the both edges of the developing agent carrier not coated with the liquid developing agent.

A primary object of the invention is to provide an image forming apparatus preventing deterioration of the accuracy of development and damaging of a developing agent carrier and a latent image carrier.

In fulfillment of the foregoing object, an apparatus are provided and are particularly well suited to a technique for forming an image with a liquid developing agent. In the present invention, an electrostatic latent image is developed at a development position with the liquid developing agent, whereby a toner image is formed, and the toner image is transferred at a transfer position onto a transfer medium. The apparatus comprises: (a) a latent image carrier which has a maximum image area and which rotates in a first direction to carry the electrostatic latent image formed within the maximum image area; (b) a developing unit which includes (b-1) a developing agent housing section which stores the liquid developing agent, (b-2) a developing agent carrier which rotates while carrying the liquid developing agent, abuts on the latent image carrier at the development position and develops the electrostatic latent image with the liquid developing agent, and (b-3) a coating roller which has a coating area, which rotates and makes the coating area contact the liquid developing agent held within the developing agent housing section, thereby scooping up the liquid developing agent from the developing agent housing section, and which rotates together with and contacts the developing agent carrier, thereby applying the liquid developing agent to the developing agent carrier; and (c) a first cleaning member which is disposed on the downstream side to the transfer position along the first direction and which removes the liquid developing agent remaining on the latent image carrier, wherein where the width of the coating area, the width of the developing agent carrier, the width of the maximum image area and the width of the first cleaning member taken along a second direction which is approximately orthogonal to the first direction are respectively W1, W2, W3 and W4, the following conditions are satisfied:

a first condition that W1>W2 is met and in the second direction, the both edges of the developing agent carrier are located on the inner side to the both edges of the coating area, a second condition that W2>W3 is met and in the second direction, the both edges of the image area are located on the inner side to the both edges of the developing agent carrier, and a third condition that W4>W2 is met and in the second direction, the both edges of the developing agent carrier are located on the inner side to the both edges of the first cleaning member.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
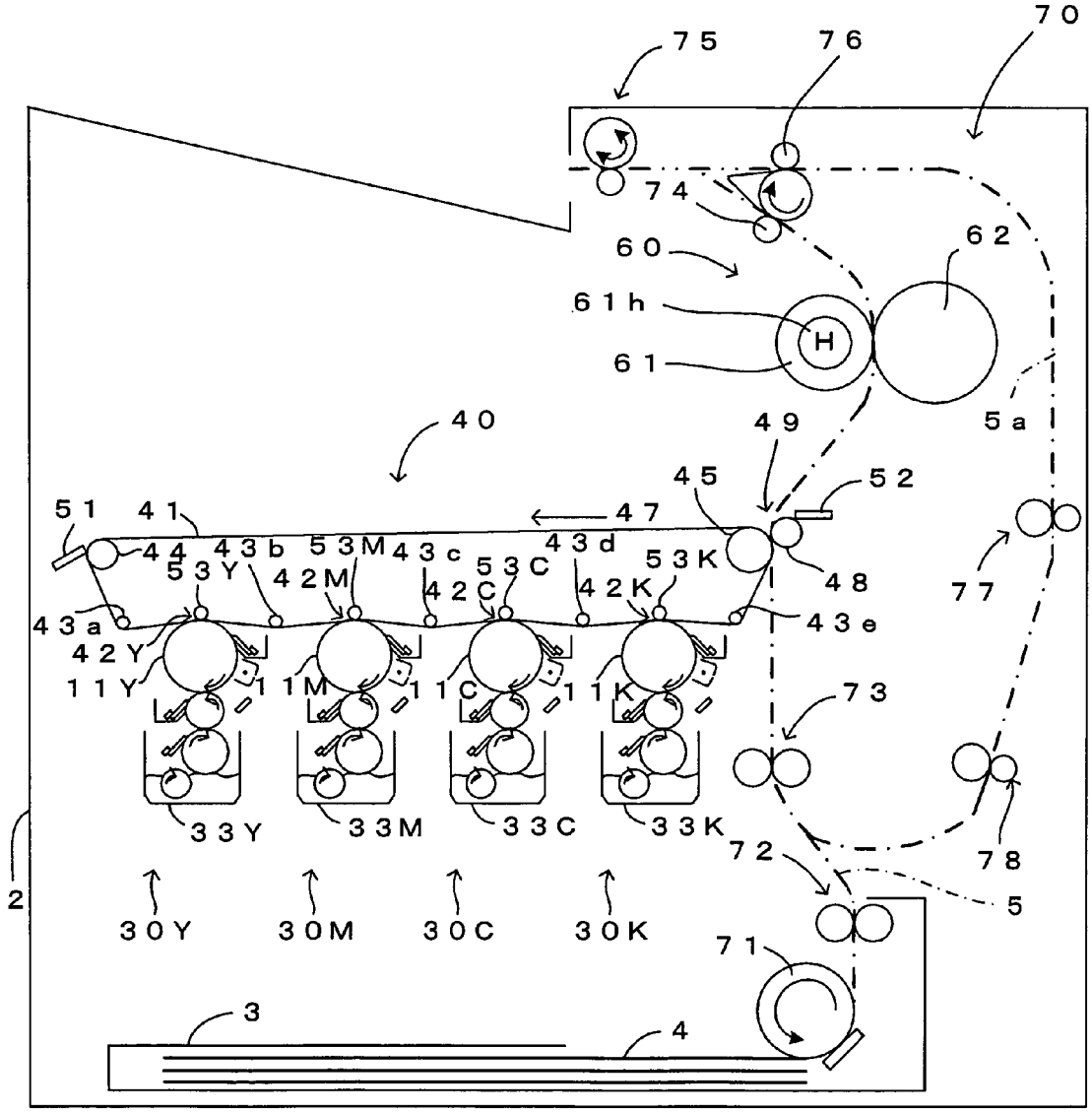
FIG. 1 is a drawing which shows the internal structure of an image forming apparatus according to the invention.
Figure 2:
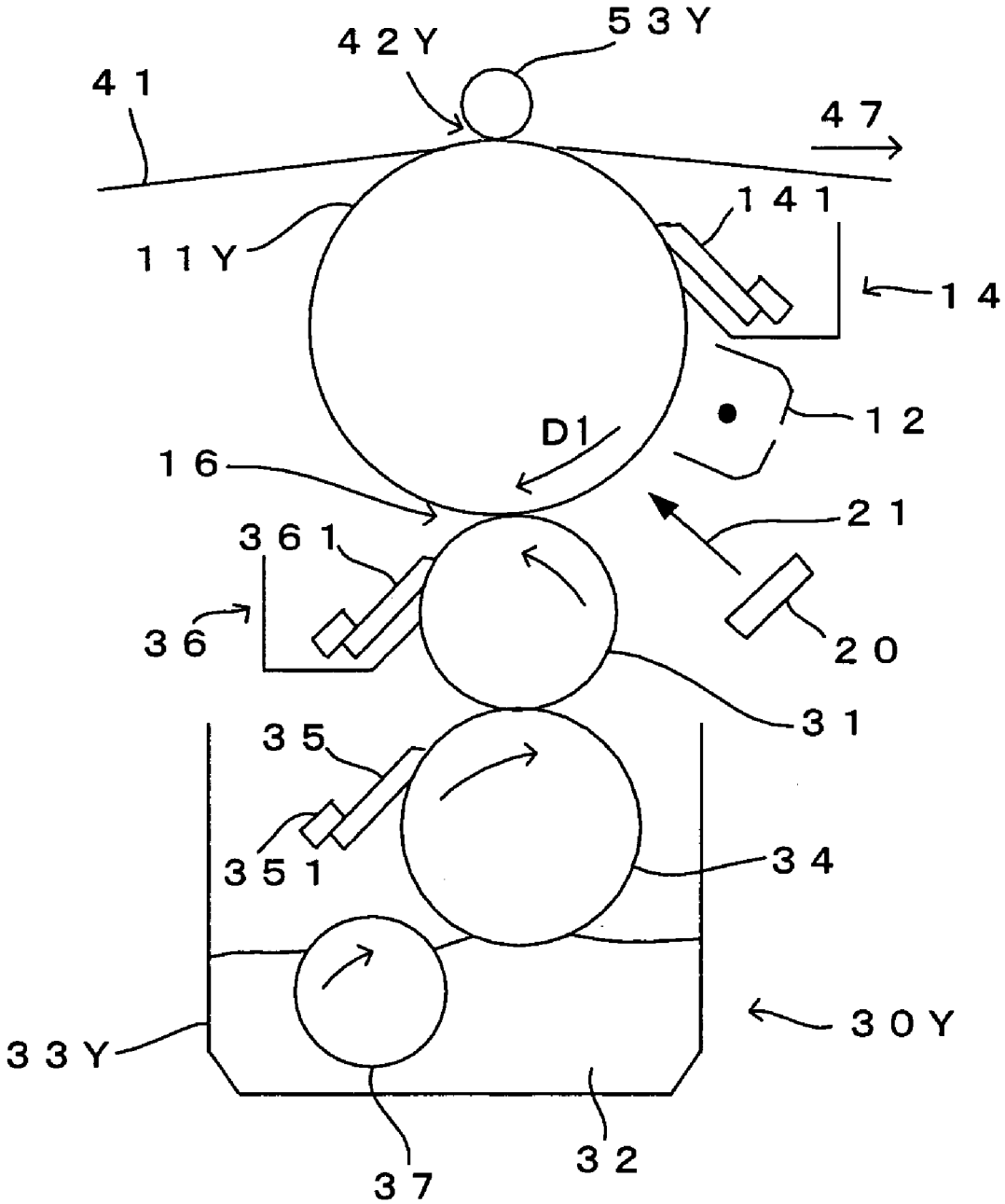
FIG. 2 is an enlarged view of an essential part in FIG. 1.
Figure 3:
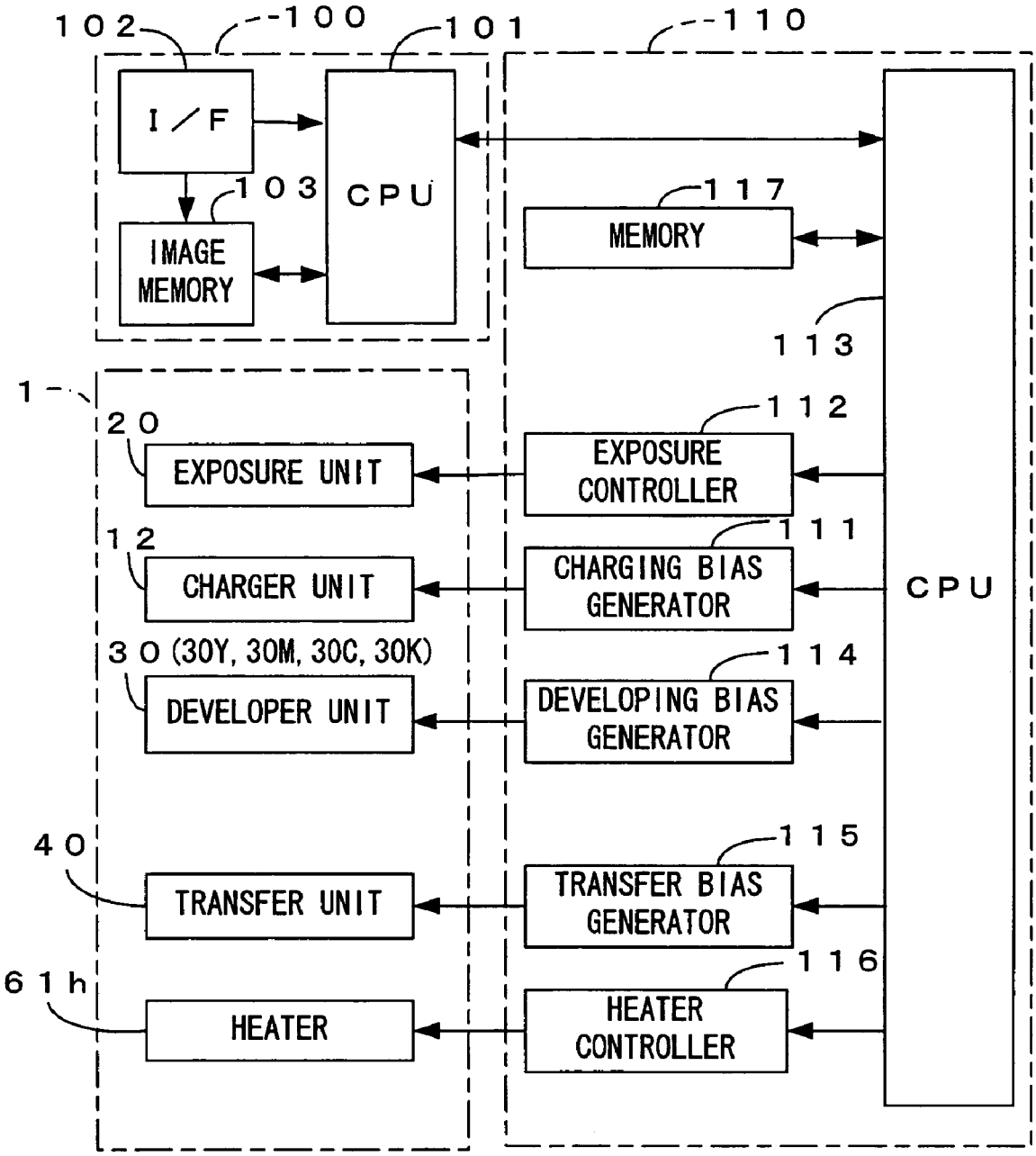
FIG. 3 is a block diagram which shows the electric structure of the printer.

FIG. 1 is a drawing which shows the internal structure of a printer, an embodiment of an image forming apparatus according to the invention. FIG. 2 is an enlarged view of an essential part in FIG. 1, and FIG. 3 is a block diagram which shows the electric structure of the printer. This image forming apparatus is a color printer of the so-called tandem type, and photosensitive members 11Y, 11M, 11C and 11K for the four colors of yellow (Y), magenta (M), cyan (C) and black (K) are disposed as the "latent image carrier" of the invention parallel to each other inside a main apparatus section 2. A liquid development method is implemented in this printer, to thereby superimpose toner images carried on the photosensitive members 11Y, 11M, 11C and 11K upon each other and form a full color image, or form a monochrome image using a black (K) toner image alone. In this printer, as a print command signal containing an image signal is fed to a main controller 100 from an external apparatus such as a host computer, an engine controller 110 controls respective portions of an engine part 1 in accordance with a control signal received from the main controller 100, and an image which corresponds to the image signal is printed on a recording medium 4, which may be a transfer paper, a copy paper or a transparency for an overhead projector, which is transported from a paper feed cassette 3 which is disposed in a lower portion of the main apparatus section 2.

In the engine part 1, a charger unit 12, an exposure unit 20, a developing unit 30 (30Y, 30M, 30C, 30K) and a photosensitive unit cleaner 14 are disposed respectively for the four photosensitive members 11Y, 11M, 11C and 11K disposed parallel to each other along the direction of rotations 47 of an intermediate transfer belt 41 (which corresponds to the "transfer medium" of the present invention) which is one part of a transfer unit 40. Each one of the developing units 30Y, 30M, 30C and 30K comprises a tank 33 (33Y, 33M, 33C, 33K) (which corresponds to the "developing agent housing section" of the invention) which stores a liquid developer 32 in which toner of each color is dispersed. The structures of the charger unit 12, the exposure unit 20, the developing unit 30 and the photosensitive unit cleaner 14 are the same across all toner colors. Hence, the structures for yellow alone will be described below, and those for the other toner colors will be simply denoted at the same or corresponding reference symbols but will not be described.

As shown in FIG. 2, the photosensitive member 11Y is disposed for free rotations in the direction of the arrow D1 (the clockwise direction in FIG. 2 which corresponds to the "first direction" of the invention), and the diameter of the photosensitive member 11Y is approximately 40 mm. Around the photosensitive member 11Y, the charger unit 12, a developer roller 31, a discharger (not shown) and the photosensitive unit cleaner 14 are disposed along the direction of rotations of the photosensitive member 11Y. A surface area between the charger unit 12 and a development position 16 is an irradiation area which comes under a light beam 21 from the exposure unit 20. The charger unit 12 uniformly charges up an outer peripheral surface of the photosensitive member 11Y to a predetermined surface potential Vd (Vd=DC+600V for instance) upon application of a charging bias from a charging bias generator 111, and functions as a charger.

The exposure unit 20 irradiates the light beam 21 of laser for example toward the outer peripheral surface of the photosensitive member 11Y thus uniformly charged by the charger unit 12. The exposure unit 20 exposes the photosensitive member 11Y with the light beam 21 in accordance with a control command fed from an exposure controller 112 to form on the photosensitive member 11Y a yellow electrostatic latent image which corresponds to the image signal. When a print command signal containing an image signal is fed to a CPU 101 of the main controller 100 from an external apparatus such as a host computer via an interface 102 for instance, in response to a command from the CPU 101 of the main controller 100, a CPU 113 outputs a control signal suitable to this image signal to the exposure controller 112 at predetermined timing. The exposure unit 20 irradiates the photosensitive member 11Y with the light beam 21 in accordance with a control command from the exposure controller 112, whereby a yellow electrostatic latent image which corresponds to the image signal is formed on the photosensitive member 11Y. When a patch image needs be formed, the CPU 113 provides the exposure controller 112 with a control signal corresponding to a patch image signal which expresses a predetermined pattern (e.g., a solid image, a thin line image, a white thin line image), and a yellow electrostatic latent image which corresponds to this pattern is formed on the photosensitive member 11Y.

The yellow electrostatic latent image formed in this manner is visualized with yellow toner which is supplied from the developer roller 31 of the developing unit 30Y (developing step). The yellow toner image formed on the photosensitive member 11Y is transported to a primary transfer position 42Y (which corresponds to the "transfer position" of the invention) which is opposed against a primary transfer roller 53Y, as the photosensitive member 11Y rotates. The primary transfer roller 53Y is located such that the intermediate transfer belt 41 comes between the primary transfer roller 53Y and the photosensitive member 11Y. Further, the intermediate transfer belt 41 runs across plural rollers 43*a* through 45, and when driven by a drive motor not shown, rotates in the direction 47 (the counter-clockwise direction in FIG. 1) which follows the photosensitive member 11Y at the same peripheral speed as the photosensitive member 11Y. Upon application of a primary transfer bias (which may be DC—400V, for instance) from a transfer bias generator 115, the yellow toner image on the photosensitive member 11Y is primarily transferred onto the intermediate transfer belt 41 at the primary transfer position 42Y (transfer step). The discharger formed by an LED or the like removes residual charges remaining on the photosensitive member 11Y after the primary transfer, and the photosensitive unit cleaner 14 removes the residual liquid developer. The structure and the operation of this the developing unit 30Y and the structure and the operation of the photosensitive unit cleaner 14 will be described in detail later.

Similar structures to that for yellow (Y) are used for the other toner colors, and toner images corresponding to the image signal are formed. The toner images in the respective colors of yellow (Y), magenta (M), cyan (C) and black (K) formed on the photosensitive members 11Y, 11M, 11C and 11K are primarily transferred at the primary transfer positions 42Y, 42M, 42C and 42K which are opposed against the primary transfer rollers 53Y, 53M, 53C and 53K and consequently superimposed one atop the other on the surface of the intermediate transfer belt 41, and a full color toner image is formed.

The toner image formed on the intermediate transfer belt 41 is transported to a secondary transfer position 49 which is between rollers 45 and 48, as the intermediate transfer belt 41 rotates. The recording medium 4 stored in the paper feed cassette 3 (FIG. 1) is transported to the secondary transfer position 49 by a transportation unit 70 will be described later, in synchronization to the transportation of the primarily transferred toner image. The roller 48 rotates in the direction (the clockwise direction in FIG. 1) which follows the intermediate transfer belt 41 at the same peripheral speed as the intermediate transfer belt 41, and upon application of a secondary transfer bias from the transfer bias generator 115, the toner image on the intermediate transfer belt 41 is secondarily transferred onto the recording medium 4. The roller 48 may be of urethane rubber whose hardness is about 50 in JIS-A scale and may have a diameter of about 25 mm. Since this embodiment achieves transfer using the rollers, a transfer condition may be set through constant voltage control or constant current control. Corona discharge may be used for transfer instead of using the rollers, in which case the output of corona discharge may be controlled to set a transfer condition. A cleaning blade 51 removes the residual liquid developer on the intermediate transfer belt 41 after the secondary transfer.

The recording medium 4 now seating the secondarily transferred toner image is transported along a predetermined transportation path 5 (denoted at the chain line in FIG. 1), and a fixing unit 60 fixes the toner image on the recording medium 4 which will then be discharged to a discharge tray which is disposed in an upper portion of the main apparatus section 2. The fixing unit 60 comprises a heat roller 61 equipped with a built-in heater 61*h* and a press roller 62 which contacts the heat roller 61. As a heater controller 116 controls activation of the heater 61*h*, a fixing temperature in the fixing unit 60 is adjusted to any desired temperature.

In this embodiment, the image forming apparatus further comprises the transportation unit 70 which transports the recording medium 4 along the predetermined transportation path 5. In the transportation unit 70, as shown in FIG. 1, a paper feed roller 71 is disposed for the paper feed cassette 3. With the paper feed roller 71, one recording medium 4 is retrieved at a time from the paper feed cassette 3 and transported to a feed roller 72. The feed roller 72 then transports the recording medium 4 to a gate roller 73, and the recording medium 4 is temporarily held stand-by at the position of the gate roller. The gate roller 73 is driven at timing for the secondary transfer operation described above, and feeds the recording medium 4 to the secondary transfer position 49. Disposed for the discharge tray are a pre-discharge roller 74, a discharge roller 75 and an inverting roller 76. The recording medium 4 as it is after the secondary transfer is transported to the discharge tray via the fixing unit 60, the pre-discharge roller 74 and the discharge roller 75.

In FIG. 3, the main controller 100 comprises an image memory 103 which stores the image signal fed from an external apparatus via the interface 102. Receiving the print command signal containing the image signal from the external apparatus via the interface 102, the CPU 101 converts the print command signal into job data in a suitable format to instruct the engine part 1 to operate and sends the job data to the engine controller 110.

A memory 117 of the engine controller 110 is formed by a ROM which stores a control program for the CPU 113 including preset fixed data, a RAM which temporarily stores control data for the engine part 1, a computation result derived by the CPU 113, etc. The CPU 113 stores in the memory 117 data regarding the image signal sent from the external apparatus via the CPU 101.

Figure 4:
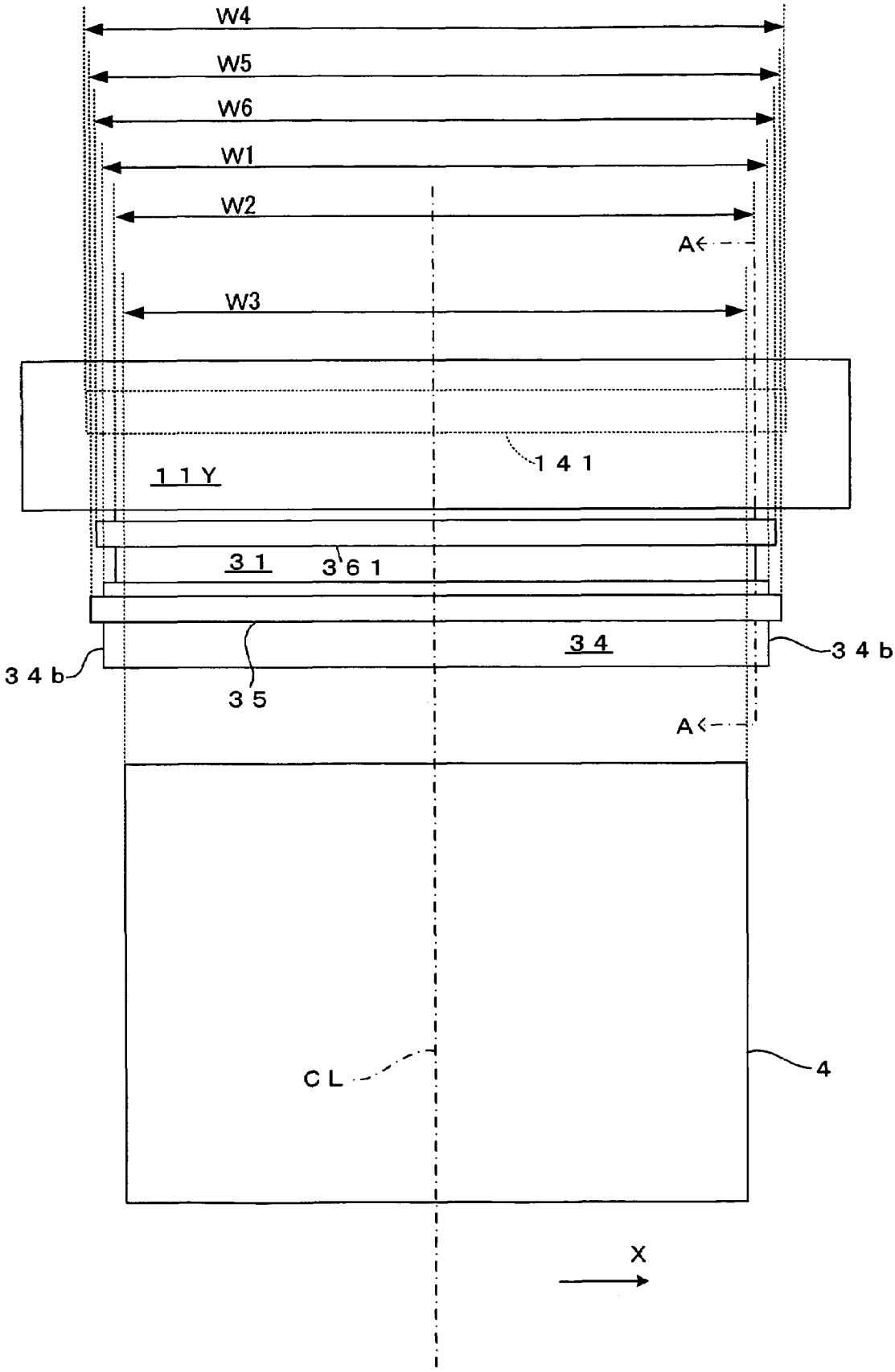
FIG. 4 is a schematic drawing which shows a relationship between the developing unit and the photosensitive unit cleaner.
Figure 5:
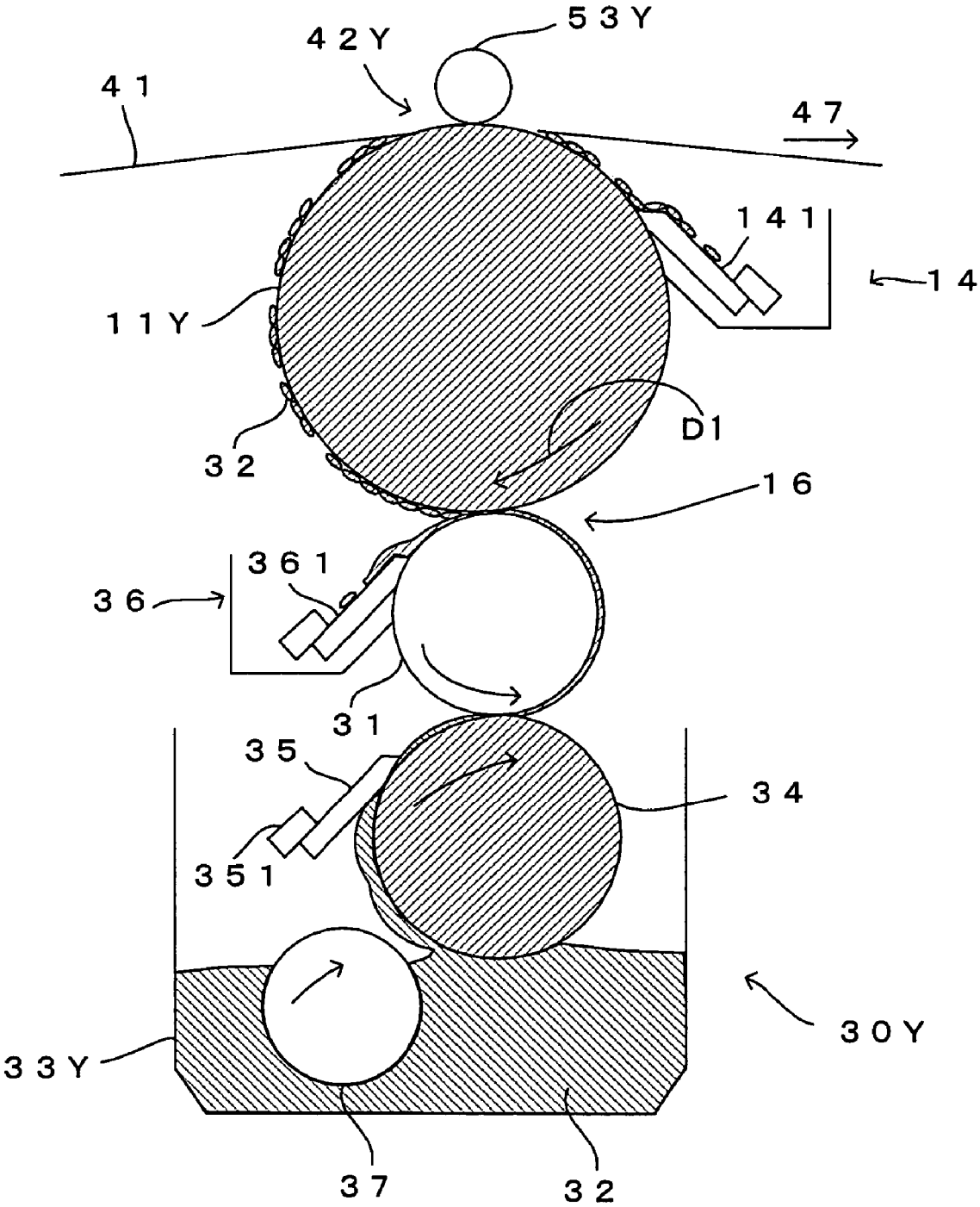
FIG. 5 is a cross sectional view of FIG. 2 taken along the cross section A—A in FIG. 4.
Figure 6:
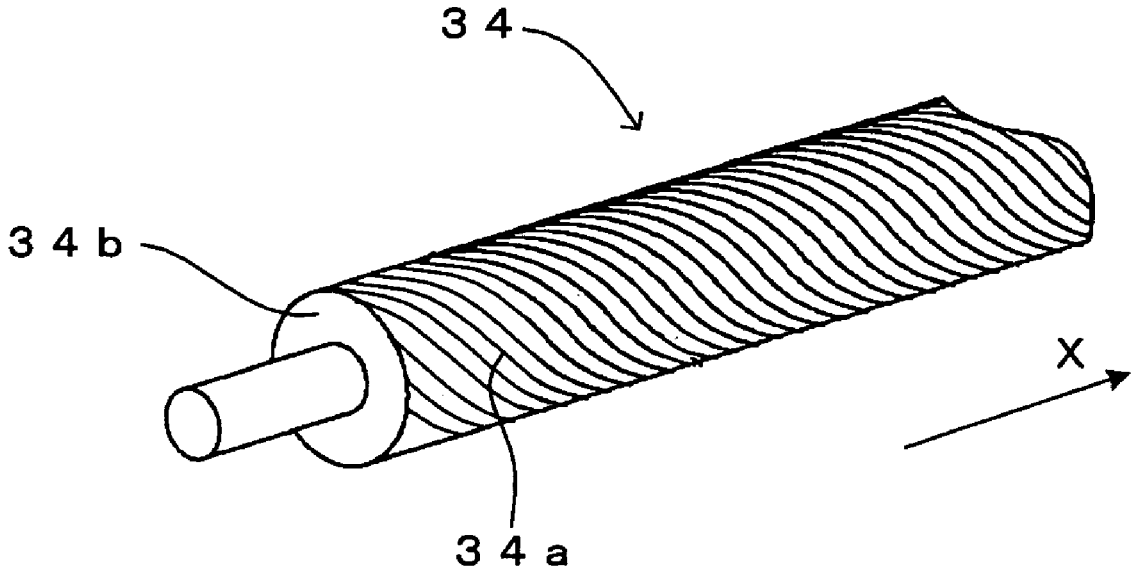
FIG. 6 is a perspective conceptual view of an anilox roller whose surface has grooves.

The structure and the operation of this the developing unit 30Y and the structure and the operation of the photosensitive unit cleaner 14 will now be described in detail with reference to FIGS. 2, 4 and 6. FIG. 4 is a schematic drawing which shows a relationship between the developing unit and the photosensitive unit cleaner. In FIG. 4, the developing unit and the photosensitive unit cleaner are disposed relative to each other when they are viewed from the left-hand side toward FIG. 2. FIG. 5 is a cross sectional view of FIG. 2 taken along the cross section A—A in FIG. 4. FIG. 6 is a perspective conceptual view of an anilox roller whose surface has grooves. The structures of the developing units 30M, 30C and 30K are similar to the structure of the developing unit 30Y, and therefore will be denoted at the same or corresponding reference symbols but will not be described.

The developing unit 30Y comprises: the developer roller 31 (which corresponds to the "developing agent carrier" of the invention); the tank 33Y which stores the liquid developer 32 in which yellow toner is dispersed; an agitating roller 37 which agitates the liquid developer 32 held in the tank 33Y; a coating roller 34 which scoops up the liquid developer 32 and applies the liquid developer 32 to the developer roller 31; a regulator blade 35 (which corresponds to the "regulator member" of the invention) which uniformly restricts the thickness of a liquid developer layer on the coating roller 34; and a developer roller cleaner 36 which removes the liquid developer remaining on the developer roller 31 after the toner has been supplied to the photosensitive member 11Y. The developer roller 31 rotates in the direction (the counterclockwise direction in FIG. 2) which follows the photosensitive member 11Y approximately at the same peripheral speed as the photosensitive member 11Y. Meanwhile, the coating roller 34 rotates in the direction (the clockwise direction in FIG. 2) which follows the developer roller 31 approximately at the same peripheral speed as the developer roller 31.

In this embodiment, the liquid developer 32 (which corresponds to the "liquid developing agent" of the invention) is obtained by dispersing toner in a carrier liquid. The toner is formed by a coloring pigment whose average particle diameter is from about 0.1 to about 5 μm, a binder of an epoxy resin or the like which bonds the coloring pigment, an electric charge control agent which provides a predetermined electric charge to toner, a dispersing agent which uniformly disperses the coloring pigment, etc. This embodiment uses silicon oil such as polydimethylsiloxane oil for instance as the carrier liquid and sets the toner density to 5 through 40 wt % which is higher than that of a low-density liquid developer (having the toner density of 1 through 2 wt %) which is popular for liquid development methods. The type of the carrier liquid is not limited to silicon oil. The viscosity of the liquid developer 32, which is determined by the materials of the carrier liquid, the toner and the toner density, etc., is set to 100 through 10000 mPa·s in this embodiment.

The gap between the photosensitive member 11Y and the developer roller 31 (namely, a development gap=the thickness of the liquid developer layer) is set to 5 through 40 μm for instance in this embodiment. The development nip distance (which is a distance along the circumferential direction over which the liquid developer layer is in contact with both the photosensitive member 11Y and the developer roller 31) is set to 5 mm for example in this embodiment. While a development gap of 100 to 200 μm is necessary to secure the bulk of toner where a low-density liquid developer like the one mentioned above is used, the development gap is short in this embodiment because of the high-density liquid developer. This shortens a distance which the toner moves in the liquid developer due to electrophoresis, and further, since a stronger electric field develops even at the same developing bias, more efficient and faster development is attained.

The agitating roller 37 scoops up the liquid developer 32 which is held in the tank 33Y, and transports the same to the coating roller 34. A lower portion of the agitating roller 37 is dipped in the liquid developer 32 which is held in the tank 33Y, and the agitating roller 37 is away from the coating roller 34 over a distance of about 1 mm. The agitating roller 37 is capable of rotating about its central axis which is located below the central axis of rotations of the coating roller 34. The agitating roller 37 rotates in the same direction as the direction of rotations (the clockwise direction in FIG. 5) of the coating roller 34. Besides the function of scooping up the liquid developer 32 which is held in the tank 33Y and transporting the same to the coating roller 34, the agitating roller 37 also has a function of agitating the liquid developer 32 so that the liquid developer 32 is kept in a proper condition. A metallic roller of iron for instance having a diameter of about 20 mm may be used as this agitating roller.

The coating roller 34 supplies to the developer roller 31 the liquid developer 32 which has been transported from the tank 33Y by the agitating roller 37. The coating roller 34 is generally referred to as "an anilox roller" whose metallic roller surface of iron or the like has grooves 34*a* which are uniformly formed in a spiral arrangement as shown in FIG. 6, and the diameter of the coating roller 34 is about 25 mm. In this embodiment, as shown in FIG. 6, the grooves 34*a* are formed in a coating area which is the entire surface of the coating roller 34. The width of the coating roller 34 is W1 along the X-direction (which corresponds to the "second direction" of the invention as shown in FIGS. 4 and 6) which is approximately orthogonal to the direction of rotations D1 of the latent image carrier. Contacting the liquid developer 32 while rotating clockwise, the coating roller 34 carries the liquid developer 32 in its grooves 34*a* and transports the liquid developer 32 to the developer roller 31. The coating roller 34 is therefore capable of applying the liquid developer 32 to the developer roller 31 over the width W1 along the X-direction (the width of the coating area taken along the X-direction) in which there are the grooves 34*a*.

Further, for proper application of the liquid developer 32 on the coating roller 34 to the developer roller 31, the surface of the coating roller 34 is in contact under pressure with a layer of an elastic member of the developer roller 31 which will be described later. The coating roller 34 is capable of rotating about its central axis which is located below the central axis of rotations of the developer roller 31. The coating roller 34 rotates in the opposite direction (the clockwise direction in FIG. 5) to the direction of rotations (the counterclockwise direction in FIG. 5) of the developer roller 31.

The regulator blade 35 abuts on the surface of the coating roller 34 and restricts the amount of the liquid developer 32 on the coating roller 34. In short, the regulator blade 35 wipes off an excessive amount of the liquid developer 32 on the coating roller 34 and measures the amount of the liquid developer 32 on the coating roller 34 to be supplied to the developer roller 31. The width of regulation along the X-direction over which the regulator blade 35 provides restriction is W5. The regulator blade 35 is made of urethane rubber, and is supported by a regulator blade support member 351 of metal such as iron. The hardness of the rubber of the regulator blade 35 is about 62 JIS-A. The hardness (approximately 62) of the regulator blade 35 in the abutting portion where the regulator blade 35 abuts on the surface of the coating roller 34 is lower than the hardness (approximately 85) of the elastic member layer of the developer roller 31 which will be described later in the pressure-contact portion where the developer roller 31 is in contact under pressure with the surface of the coating roller 34. In this embodiment, the regulator blade 35 is disposed such that its front tip is directed toward the downstream side along the direction of rotations the coating roller 34, for the purpose of so-called trail regulation.

To develop the electrostatic latent image carried on the photosensitive member 11Y with the liquid developer 32, the developer roller 31 carries and transports the liquid developer 32 to the development position 16 which is opposed against the photosensitive member 11Y. The developer roller 31 comprises, at the outer peripheral surface of a metallic inner core of iron or the like, the elastic member layer which is one example of a conductive elastic portion, and the diameter of the elastic member layer is about 20 mm. The elastic member layer has a double-layer structure in which the inner layer is of urethane rubber whose hardness is about 30 JIS-A and whose thickness is about 5 mm and the surface layer (outer layer) is of urethane rubber whose hardness is about 85 JIS-A and whose thickness is about 30 μm. The surface layer of the developer roller 31 serves as the pressure-contact portion in which the developer roller 31 contacts under pressure, as it is elastically deformed, the coating roller 34 and the photosensitive member 11Y. The width of the developer roller 31 along the X-direction is W2.

The developer roller 31 is capable of rotating about its central axis which is located below the central axis of rotations of the photosensitive member 11Y. The developer roller 31 rotates in the opposite direction (the counterclockwise direction in FIG. 3) to the direction of rotations D1 of the photosensitive member 11Y. During development of the electrostatic latent image formed on the photosensitive member 11Y, an electric field is created between the developer roller 31 and the photosensitive member 11Y.

The developer roller cleaner 36 comprises a developer roller cleaning blade 361 (which corresponds to the "second cleaning member" of the invention) of rubber which abuts on the surface of the developer roller 31. The developer roller cleaner 36 is a device which scrapes off, with its developer roller cleaning blade 361, the liquid developer 32 which remains on the developer roller 31 after development at the development position 16. The developer roller cleaning blade 361 can remove the liquid developer 32 with the width W6 along the X-direction which corresponds to the "width of the second cleaning member" of the invention. In other words, over the width W6, it is possible to remove the liquid developer 32 off from the surface of the developer roller 31.

In the developing unit 30Y having this structure, as the agitating roller 37 rotates about its central axis, the liquid developer 32 which is held in the tank 33Y is scooped up and transported to the coating roller 34. The liquid developer 32 transported to the coating roller 34 reaches the abutting position at which the coating roller 34 abuts on the regulator blade 35, the coating roller 34 rotates. While the liquid developer 32 moves passed the abutting position, the regulator blade 35 wipes off an excessive amount of the liquid developer 32, and the amount of the liquid developer 32 to be supplied to the developer roller 31 is consequently measured. In other words, owing to the grooves 34*a* of the coating roller 34 described above, the regulator blade 35 abutting on the coating roller 34 wipes the liquid developer 32 off from the coating roller 34 except for the liquid developer 32 carried in the grooves 34*a*. Further, since the size of the grooves 34*a* is determined so that a proper amount of the liquid developer 32 will be supplied to the developer roller 31, when the regulator blade 35 wipes off the liquid developer 32 on the coating roller 34, the liquid developer 32 measured by the grooves 34*a* to the exact amount is left in the grooves 34*a*.

The coating roller 34 scoops up the liquid developer 32 which is held in the tank 33Y, the regulator blade 35 restricts the amount of the liquid developer 32 on the coating roller 34 to the constant amount, the constant liquid developer 32 is applied to the surface of the developer roller 31, and as the developer roller 31 rotates, the liquid developer 32 is transported to the development position 16 which is opposed against the photosensitive member 11Y. The toner inside the liquid developer 32 is positively charged for instance, due to the function of the electric charge control agent or the like.

At the development position 16, the liquid developer 32 carried on the developer roller 31 is supplied from the developer roller 31 to and adheres to the photosensitive member 11Y. A developing bias Vb (Vb=DC+400V for example) applied upon the developer roller 31 from a developing bias generator 114 moves the yellow toner from the developer roller 31 to the photosensitive member 11Y and the yellow electrostatic latent image is visualized. The liquid developer left on the developer roller 31 without adhering to the photosensitive member 11Y is scraped off by the developer roller cleaning blade 361.

The yellow toner image thus formed on the photosensitive member 11Y is primarily transferred onto the intermediate transfer belt 41 at the primary transfer position 42Y as described earlier. And the photosensitive unit cleaner 14 removes the residual liquid developer 32 remaining on the photosensitive member 11Y after the primary transfer. The photosensitive unit cleaner 14 comprises a photosensitive cleaning blade 141 (which corresponds to the "first cleaning member" of the invention) of rubber which abuts on the surface of the photosensitive member 11Y. The photosensitive cleaning blade 141 is capable of scraping off and removing with its photosensitive cleaning blade 141 the liquid developer 32 which is left on the photosensitive member 11Y after the primary transfer of the toner image onto the intermediate transfer belt 41. The photosensitive cleaning blade 141 can remove the liquid developer 32 with width W4 along the X-direction which corresponds to the "width of the first cleaning member" of the invention. In other words, over the width W4, it is possible to remove the liquid developer 32 off from the surface of the photosensitive member 11Y.

A detailed description will now be given, with reference to FIG. 4, the positional relationship among the photosensitive member 11Y, the developer roller 31, the coating roller 34, the recording medium 4, the photosensitive cleaning blade 141, the developer roller cleaning blade 361 and the regulator blade 35. In this embodiment, the width W3 of the recording medium 4 taken along the X-direction is the maximum width of an image area, namely, an area in which an electrostatic latent image is formed on the photosensitive member 11Y in the invention. The area having the width W3 corresponds to the "maximum image area" of the invention.

In this embodiment, as shown in FIG. 4, the photosensitive member 11Y, the developer roller 31, the coating roller 34, the recording medium 4, the photosensitive cleaning blade 141, the developer roller cleaning blade 361 and the regulator blade 35 are disposed so that approximately central sections of the widths W1 through W6 taken along the X-direction described above are on one straight line CL.

Further, in this embodiment, the widths W1 through W6 are set to satisfy the five conditions below.

First Condition:

W1>W2 is met, and in the X-direction, the both edges of the developer roller 31 are located on the inner side to the both edges of the coating roller 34 (coating area).

Second Condition:

W2>W3 is met, and in the X-direction, the both edges of the recording medium 4 (image area) are located on the inner side to the both edges of the developer roller 31.

Third Condition:

W4>W2 is met, and in the X-direction, the both edges of the developer roller 31 are located on the inner side to the both edges of the photosensitive cleaning blade 141.

Fourth Condition:

W5>W2 is met, and in the X-direction, the both edges of the developer roller 31 are located on the inner side to the both edges of the regulator blade 35 (the width of regulation).

Fifth Condition:

W6>W2 is met, and in the X-direction, the both edges of the developer roller 31 are located on the inner side to the both edges of the developer roller cleaning blade 361.

The operations of the developing unit 30Y and the photosensitive unit cleaner 14 will now be described with reference to FIG. 5. First, as the agitating roller 37 rotates, the liquid developer 32 transported to the coating roller 34 is carried by the grooves 34*a* which are formed in the surface of the coating roller 34 and transported to the developer roller 31. At this stage, the liquid developer, which has built up at the edge surfaces 34*b* of the coating roller 34, moves toward the developer roller 31 because of the centrifugal force created by rotations of the coating roller 34. However, since the first condition above is satisfied, the both edges of the coating roller 34 are on the outer side to the both edges of the developer roller 31. Hence, the liquid developer 32 swept up the edge surfaces of the coating roller 34 by the centrifugal force will not adhere to the developer roller 31.

In addition, it is possible of a uniform coating of the liquid developer 32 under the fourth condition. While the regulator blade 35 regulates the amount of the liquid developer 32 applied to the developer roller 31 from the coating roller 34, the fourth condition above is satisfied. Thus, it is possible to coat the entire surface of the developer roller 31 uniformly with the liquid developer 32 which is restricted in amount. Since the second condition above is satisfied, it is possible to introduce the liquid developer 32 even into the other portion than the image area on the photosensitive member 11Y within the abutting portion of the photosensitive member 11Y and the developer roller 31 (i.e., at the development position 16). For instance, the liquid developer 32 stays on the abutting portion where the edges of the developer roller 31 abut on the photosensitive member 11Y for example as shown in FIG. 4.

After the developing step at the development position 16, the liquid developer 32 on the surface of the developer roller 31 is removed. In the embodiment, the fifth condition, which defines the relationship between the developer roller 31 and the regulator blade 35, is satisfied. Hence, the developer roller cleaning blade 361 can cleanly remove the liquid developer 32 remaining on the surface of the developer roller 31, including the liquid developer 32 building up at the edges of the developer roller 31. Further, since the third condition above is satisfied, after the transfer step, the photosensitive cleaning blade 141 can cleanly remove the liquid developer 32 which has adhered to the photosensitive member 11Y from the edges of the developer roller 31 during the developing step.

For example, the image forming apparatus may have the following specific structure which satisfies the first through the fifth conditions above.

The width of the coating roller 34 (the width of the coating area) W1 is 313 mm.

The width of the developer roller 31 (the width of the developing agent carrier) W2 is 307 mm.

The width of the recording paper 4 (the width of the image area) W3 is 297 mm.

The width of the photosensitive cleaning blade 141 (the width of the first cleaning member) W4 is 329 mm.

The width of the regulator blade 35 (the width of regulation) W5 is 316 mm.

The width of the developer roller cleaning blade 361 (the width of the second cleaning member) W6 is 316 mm.

The width of the agitating roller 37 is 337 mm.

The width of the photosensitive member is 392 mm.

The width of the intermediate transfer belt 41 is about 320 mm.

The width of the cleaning blades 51 and 52 is 316 mm.

The width of the roller 48 is 300 mm.

An image was formed with an image forming apparatus designed as such, and it was found that a deteriorated accuracy of development was prevented and damaging of the developer roller 31 and the photosensitive member was prevented.

As described above, in this embodiment, the first condition above is satisfied and the both edges of the developer roller 31 are located on the inner side to the both edges of the coating roller 34 along the X-direction. Hence, it is possible to prevent the centrifugal force, which created by rotations of the coating roller 34, from blowing up the liquid developer 32 which has built up at the edge surfaces 34*b* of the coating roller 34 to the developer roller 31. This prevents uneven application of the liquid developer 32 to the surface of the developer roller 31 which will be otherwise caused by a blown-up liquid developer 32. It is therefore possible to avoid development of electrostatic latent images formed in the image areas of the photosensitive members 11Y, 11M, 11C and 11K with the liquid developer 32 unevenly applied to the developer rollers 31 and prevent the resulting toner images from having uneven densities.

Further, since the first and the second conditions above are satisfied at the same time, the following effects are obtained. The first condition is satisfied, so that the both edges of the developer roller 31 are located on the inner side to the both edges of the coating roller 34 (coating area) along the X-direction. Therefore, it is possible to coat the entire surface of the developer roller 31 with the liquid developer 32 which has been scooped up by the coating roller 34. Furthermore, the second condition is satisfied, so that the both edges of the image area are located on the inner side to the both edges of the developer roller 31 along the X-direction. Therefore, the both edges of the developer roller 31 abut on the photosensitive member on the outer side to the image area on the photosensitive member during development with the liquid developer 32 on the developer roller 31. As the first and the second conditions above are satisfied simultaneously, it is possible to introduce the liquid developer 32 to the abutting portion as a whole between the photosensitive member and the developer roller 31, including the other portion to be developed than the image area on the photosensitive member. This attains the same friction factor all over the abutting portion and accordingly makes the photosensitive member and the developer roller stably rotate while abutting on each other. It is therefore possible to prevent damaging of the surface of the photosensitive member or the developer roller 31.

In the embodiment above, the coating roller 34 coats the liquid developer 32 to the entire surface of the developer roller 31. The application of the liquid developer 32 could create a pool of the liquid developer 32 at the both edge surfaces of the developer roller 31. However, since the both edges of the developer roller 31 abut on the photosensitive member on the outer side to the image area, the both edges of the developer roller 31 will not contact an electrostatic latent image which is formed in the image area on the photosensitive member. This avoids development of the electrostatic latent image with the liquid developer 32 which has built up in the both edge surfaces of the developer roller 31 during development of the electrostatic latent image and prevents the toner image resulting on the photosensitive member from having an uneven density.

Further, the third condition above is satisfied, so that the both edges of the developer roller 31 are located on the inner side to the both edges of the photosensitive cleaning blade 141. It is therefore possible to remove all of the liquid developer 32 remaining on the photosensitive member, including the liquid developer 32 adhering to the other portion than the image area on the photosensitive member. The unwanted liquid developer 32 on the photosensitive member can reliably removed before development of an electrostatic latent image formed in the image area on the photosensitive member with the developer roller 31. This prevents unwanted retention and accumulation of the liquid developer 32 on the photosensitive member and thus prevents a deteriorated accuracy of development such as a ghost attributable to unwanted accumulation of the liquid developer 32 on the photosensitive member.

Further, the fourth condition above is satisfied, so that the both edges of the developer roller 31 are located on the inner side to the both edges of the width of regulation along the X-direction. It is possible to apply to the entire surface of the developer roller 31 a uniform film of the liquid developer 32 whose amount has been regulated on the coating roller 34. Since uniform application of the liquid developer 32 to the entire surface of the developer roller 31 is possible, it is possible to develop an electrostatic latent image formed in the image area on the photosensitive member with the liquid developer 32 uniformly applied to the developer roller 31. This suppresses a density variation during development of the electrostatic latent image. In addition, since the restricted amount of the liquid developer 32 is applied to the developer roller 31, it is possible to prevent unwanted retention and accumulation of the liquid developing agent at the edge surfaces of the developer roller 31, etc.

Further, the fifth condition is satisfied, so that the both edges of the developer roller 31 are located on the inner side to the both edges of the developer roller cleaning blade 361 along the X-direction. It is possible to remove all of the unwanted liquid developer 32 remaining on the developer roller 31 before application of the liquid developer 32 to the surface of the developer roller 31 by the coating roller 34 after development of the electrostatic latent image on the photosensitive member. While application of the liquid developer 32 to the surface of the developer roller 31 accompanies unwanted retention of the liquid developer 32 on the surface of the developer roller 31, the unwanted retention is removed off by the developer roller cleaning blade 361. Therefore, it is possible to prevent uneven application of the liquid developer 32 to the surface of the developer roller 31. This avoids development of an electrostatic latent image formed in the image area of the photosensitive member with the liquid developer 32 unevenly applied to the developer roller 31 and prevents the resulting toner image from having an uneven density. In addition, the unwanted liquid developer 32 is completely removed off from the developer roller 31 every time an electrostatic latent image formed in the image area of the photosensitive member is developed. This prevents unwanted accumulation of the liquid developer 32 at the edges of the developer roller 31, etc. It is therefore possible to prevent an inconveniently accumulated liquid developer 32 from entering the abutting portion where the developer roller 31 abuts on the image area of the photosensitive member. This avoids development of an electrostatic latent image on the photosensitive member with the presence of the unwanted liquid developer 32 in the abutting portion and obviates a deteriorated accuracy of development which may manifest itself as a varied density of the resulting toner image for instance.

Further, in this embodiment, since the liquid developer 32 is carried in the grooves of the coating roller 34 (anilox roller), a constant and measured amount of the liquid developer 32 is applied to the developer roller 31. It is thus possible to uniformly and accurately apply the liquid developer 32 to the developer roller 31. As the developer roller 31 evenly coated with the liquid developer 32 abuts on the photosensitive member and an electrostatic latent image on the photosensitive member is developed, the accuracy of development of this electrostatic latent image is excellent.

Figure 7:
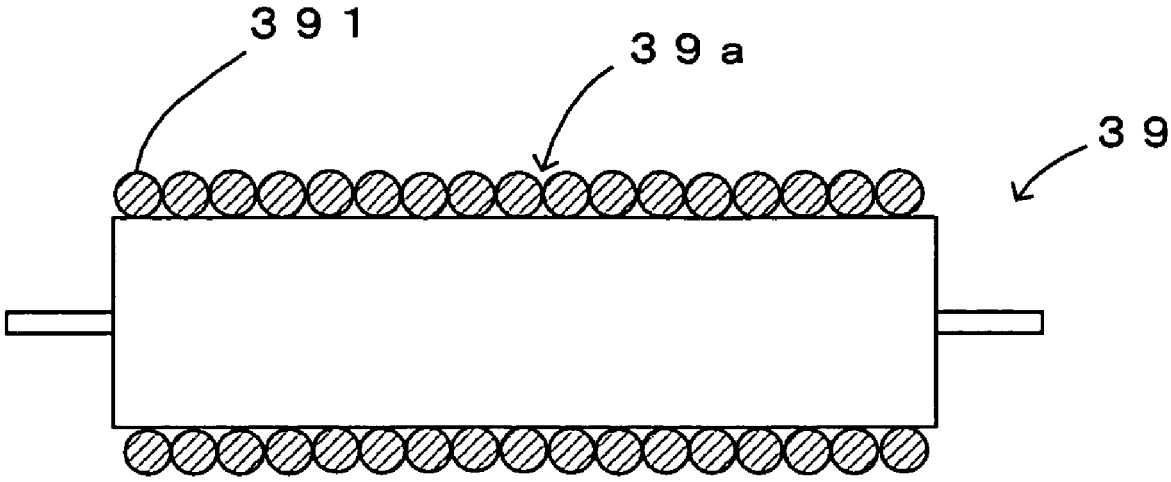
FIG. 7 is a cross sectional view of wire bar.

The invention is not limited to the embodiment above, but may be modified in various manners in addition to the preferred embodiments above, to the extent not deviating from the object of the invention. For instance, although the embodiment above uses an anilox roller as the coating roller 34, a wire bar 39 as that shown in the schematic drawing in FIG. 7 may be used instead. The wire bar 39 may be obtained by winding around a metal core a wire 391 having a wire diameter of 100 μm in the intervals of 100 μm, for example. Concave sections 39*a* between the wire sections created by winding the wire 391 around the metal core attains a similar function to that of the grooves 34*a* of the anilox roller (the coating roller 34).

The coating roller 34, the wire bar 39 or the like described above has the concave sections in the coating area which spreads across the full width of the coating roller 34, the wire bar 39 or the like along the X-direction. However, the invention is generally applicable to any image creating apparatus in which the coating roller 34 or the like may be used instead which satisfies the first through the fifth conditions above. In this apparatus, the coating roller 34 or the like may have a specific structure which has no concave sections at its edges and which can not carry the liquid developing agent (the liquid developer 32) at its edges where it does not have any concave sections.

Instead of using an anilox roller or wire bar, a flat surface roller may be used. In this case, a necessary gap is provided between the regulator blade 35 and this roller, and this roller carries on its surface the liquid developer 32 in a film thickness which is equal to the distance of this gap. This structure as well attains similar effects to those according to the embodiment above.

Further, although the approximately central sections of the widths W1 through W6 are on the straight line CL in the embodiment above, one ends of these widths may be aligned to each other on one straight line.

Further, one exposure unit 20 is disposed for each one of the photosensitive members 11Y, 11M, 11C and 11K so that an electrostatic latent image corresponding to each one of the photosensitive members 11Y, 11M, 11C and 11K is formed on each one of the photosensitive members 11Y, 11M, 11C and 11K in the embodiment above. An alternative structure may be used instead in which one exposure unit is disposed, and an electrostatic latent image corresponding to each one of the photosensitive members 11Y, 11M, 11C and 11K is formed on each one of the photosensitive members 11Y, 11M, 11C and 11K by switching, with a mirror or the like, the direction in which the laser beam is irradiated for instance. In addition, an exposure unit formed by an LED array may be used, or a latent image writer for so-called charging for writing. Thus any structure may be used to the extent an electrostatic latent image corresponding to each one of the photosensitive members 11Y, 11M, 11C and 11K can be formed on each one of the photosensitive members 11Y, 11M, 11C and 11K.

Further, although the embodiment above uses the developer roller as the developing agent carrier and the drum-type photosensitive members as the latent image carrier, these may be formed by belt-shaped members to the extent not deviating from the object above, in which case as well similar effects are achievable.

Further, although the regulator blade 35 realizes trail regulation in the embodiment above, the regulator blade 35 may be disposed such that the front tip of the regulator blade 35 is directed toward the upstream side along the direction of rotations the coating roller 34, for the purpose of so-called counter regulation.

Further, although the width W1 of the coating area and the width of regulation W5 of the regulator blade taken along the X-direction (second direction) hold the relationship of W5>W1 in this embodiment, to the extent that the fourth condition above is satisfied, the relationship may be W1>W5. This structure as well attains similar effects to the effects described above.

Further, although the embodiment above is application of the invention to a color printer of the tandem type, the structure according to the invention is applicable to a monochrome printer.

Further, although the foregoing has described the embodiment as a printer which prints onto a transfer paper an image fed from an external apparatus such as a host computer, the invention is not limited to this but may be applied to an ordinary image creating apparatus of the electrophotographic type including a copier machine and a facsimile machine. The invention is generally applicable to any image creating apparatus in which a coating roller temporarily carries a liquid developing agent in which toner is dispersed in a carrier liquid, thus carried liquid developing agent is applied to a developing agent carrier and the liquid developing agent applied to the developing agent carrier develops an electrostatic latent image carried on the developing agent carrier.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus in which an electrostatic latent image is developed at a development position with a liquid developing agent, whereby a toner image is formed, and the toner image is transferred at a transfer position onto a transfer medium, the apparatus comprising:

(a) a latent image carrier which has a maximum image area and which rotates in a first direction to carry the electrostatic latent image formed within the maximum image area;

(b) a developing unit which includes (b-1) a developing agent housing section which stores the liquid developing agent, (b-2) a developing agent carrier which rotates while carrying the liquid developing agent, abuts on the latent image carrier at the development position and develops the electrostatic latent image with the liquid developing agent, and (b-3) a coating roller which has a coating area, which rotates and makes the coating area contact the liquid developing agent held within the developing agent housing section, thereby scooping up the liquid developing agent from the developing agent housing section, and which rotates together with and directly contacts the developing agent carrier, thereby applying the liquid developing agent to the developing agent carrier; and (c) a first cleaning member which is disposed on the downstream side to the transfer position along the first direction and which removes the liquid developing agent remaining on the latent image carrier, wherein where the width of the coating area, the width of the developing agent carrier, the width of the maximum image area and the width of the first cleaning member taken along a second direction which is approximately orthogonal to the first direction are respectively W1, W2, W3 and W4, the following conditions are satisfied:

a first condition that W1>W2 is met and in the second direction, the both edges of the developing agent carrier are located on the inner side to the both edges of the coating area, a second condition that W2>W3 is met and in the second direction, the both edges of the image area are located on the inner side to the both edges of the developing agent carrier, and a third condition that W4>W2 is met and in the second direction, the both edges of the developing agent carrier are located on the inner side to the both edges of the first cleaning member.

2. The image forming apparatus of claim 1, wherein the developing unit further includes (b-4) a regulator member which is disposed on the, upstream side to an abutting position along the direction of rotations of the coating roller and which restricts the amount of the liquid developing agent which is carried on the coating area, the abutting position being a position at which the developing agent carrier and the coating roller contact each other, and where W5 denotes the width of regulation along the second direction over which it is possible for the regulator member to restrict the amount of the liquid developing agent which is carried on the coating area, the following condition is further satisfied:

a fourth condition that W5>W2 is met and in the second direction, the both edges of the developing agent carrier are located on the inner side to the both edges of the width of regulation.

3. The image forming apparatus of claim 1, wherein the developing unit further includes (b-5) a second cleaning member which is disposed on the downstream side to the development position along the direction of rotations of the developing agent carrier and which removes the liquid developing agent which remains on the developing agent carrier, and where the width of the second cleaning member taken along the second direction is W6, the following condition is satisfied:

a fifth condition that W6>W2 is met and in the second direction, the both edges of the developing agent carrier are located on the inner side to the both edges of the second cleaning member.

* * * * *